United States Patent [19]

Gillen et al.

[11] Patent Number: 4,519,711

[45] Date of Patent: May 28, 1985

[54] DRUM MIXER AND METHOD

[75] Inventors: Orval D. Gillen, Tempe, Ariz.; John G. Healey, Jr., Portland, Oreg.

[73] Assignee: The Tanner Companies, Phoenix, Ariz.

[21] Appl. No.: 134,373

[22] Filed: Mar. 27, 1980

[51] Int. Cl.[3] ..... B18C 5/46

[52] U.S. Cl. ..... 366/4; 366/25

[58] Field of Search ..... 366/25, 24, 23, 4, 7, 366/40, 3, 2, 6, 5

[56] References Cited

U.S. PATENT DOCUMENTS

| | | | |
|---|---|---|---|
| 2,093,232 | 9/1937 | Coulter . | |
| 3,718,131 | 2/1973 | Busse . | |
| 3,748,080 | 7/1973 | Dunn . | |
| 3,809,523 | 5/1974 | Varekamp . | |
| 3,814,567 | 6/1974 | Zink . | |
| 4,039,171 | 8/1977 | Shearer | 366/25 |
| 4,127,379 | 11/1978 | Grove . | |
| 4,143,972 | 3/1979 | Benson | 366/25 |

*Primary Examiner*—Robert W. Jenkins

*Attorney, Agent, or Firm*—Charles E. Cates; Victor Myer

[57] ABSTRACT

The productive capacity of a drum heater and mixer for asphalt paving composition intended for processing recycled materials can be increased substantially by spraying a curtain of water vertically into the pathway of the raw material as it falls into the drum intake and before any substantial contacts with heated gases or flame and by spraying a curtain of water into the pathway of the heated gases and flame for controlling the temperature profile across the interior of the drum. The latter curtain of water is disposed at about thirty-five degrees to a plane perpendicular to the drum axis. Additional sprays of water downstream from the angular curtain of water may be supplied if necessary.

7 Claims, 7 Drawing Figures

DRUM MIXER AND METHOD

BACKGROUND OF THE INVENTION

This invention relates to drum mixers and the like for aggregate and asphaltic materials such as may be used in connection with road surfacing, more particularly to such mixers for processing re-cycled road surfacing materials. This invention also relates to the method of processing of re-cycled road surfacing materials to the end of minimizing, if not eliminating, atmospheric pollution both of a particulate nature and of noxious fumes.

Drum mixers and/or dryers are well known including ones for processing or re-cycling used bituminous or asphaltic materials from existing roads and highways. U.S. Pat. No. 4,039,171, Aug. 2, 1977 and U.S. Pat. No. 4,143,972, Mar. 13, 1979 may be referred to in this connection.

Such prior drum mixers include an elongated drum that is adapted to rotate and, when in use, is mounted at a downward angle from the intake to discharge so that the processed material will move therethrough under the force of gravity. The drum is mounted on a framework supported by wheels at one end and is adapted at its other end to be attached to a tractor for towing the apparatus to the point of use.

At the intake end of the drum there is a source of high temperature gases which in the burning condition are blown into the drum and at this same end there is a conveyor arrangement for carrying the material to be heated into the drum. Essentially, at the intake end of the drum the raw materials which may be broken up pieces of old road surfacing, for example, come into contact with the flame and/or hot gases of the combustion process, are melted and carried through the drum to the discharge end for re-application to the road surface. Also at the intake area of the drum there are spirally arranged flights on the interior surface (at an angle to the drum axis) for conveying the raw material downstream. At the termination of the spiral, or angular, flights there are further mixing flights arranged parallel to the axis of the drum and cause the material the drum to tumble for mixing purposes. In this process additional asphalt, for example, may be added in order to make the desired end composition of the prescribed constituency.

In the prior devices liquid asphalt has been provided at the intake end of the drum in order to mix with the fine materials entering thereat for preventing the fines from entering into the current of heated gases and being carried through the drum to the discharge end and thus avoiding particulate contamination of the atmosphere. However, this would ordinarily cause burning of the asphalt or other similar material at the intake and thus cause noxious fumes to be emitted at the discharge end. To avoid this the prior art devices have used various schemes for reducing the temperature gradient of the hot gases and flame across the interior of the drum. These schemes have included heat dispersion screens, or grids, as in U.S. Pat. No. 4,039,171 and a completely enclosed combustion chamber having air intake holes disposed along its length and a truncated cone exit having a series of holes through which the heated gases flowed as in U.S. Pat. No. 4,143,972.

While these schemes may have solved the problems of controlling particulates and fumes into the atmosphere they, nevertheless, have the serious disadvantage of relatively low throughput or productive capacity.

Various governmental agencies, such as the Boards of Health and the Environmental Protective Agency, determine the standards of operation of drum mixers of the nature involved in this application such that the amount of the particulate matter as well as noxious fumes introduced into the atmosphere is severely limited.

The temperature gradient controlling schemes of the prior art, not only result in a relatively reduced productive capacity, but they are relatively difficult to maintain and are expensive in the first instance.

Injecting water spray into the cone of flame in a combustion chamber also is known as in U.S. Pat. No. 3,748,080, July 24, 1973. Such arrangements have been complicated and have not been suggested for drum mixers in connection with the re-cycling of bituminous road paving materials.

Accordingly, it is an object of the invention to provide an improved drum mixer of the nature discussed wherein re-cycled bituminous paving material may be processed at an increased productive capacity while at the same time minimizing the emission of particulate material and noxious fumes.

It is a further object of the invention to provide an improved drum mixer of the character described which is simple in construction, efficient in operation and simple to maintain.

Further advantages and objects of the invention will become apparent as the description proceeds.

SUMMARY OF THE INVENTION

In carrying out the invention according to one form there is provided in a bituminous paving composition mixer that includes a rotatable drum having a discharge end and an intake end, means for the introduction of raw materials into the intake end, gaseous heating apparatus disposed adjacent the intake end including means for blowing heated gases and flame into the intake end of the drum for melting the bituminous material, and means for controlling the temperature distribution of the flame and gases across the interior of the entrance of the drum during operation, the last named means comprising first apparatus for generating a series of water sprays at the entrance to the drum directed into the path of the flame and heated gases. Preferably, the spray consists of a series of relatively closely spaced streams of water directed into the pathway of the flame and gases from each side thereof and at an angle of about thirty-five degrees to a plane at right angles to the drum axis. The combination of sprays comprises essentially a water curtain. In the event that additional moisture is needed, one or more additional vertical pipes are disposed inside of the drum and include a series of horizontally directed holes through which water streams may flow into the pathway of the flame and gases. The development of undesired amounts of atmospheric contaminating noxious fumes is, accordingly, avoided. Additionally, for controlling the particulate material in the raw stock a futther conduit is disposed horizontally across the entrance of the drum and ahead of the water curtain and other sprays described so as to dampen and coagulate the particulate matter before it comes into contact with the flame and gases. These particulates, or fines, are, therefore, not caught up into the gaseous current and carried through the drum mixer. Particulate contamination of the atmosphere is, accordingly, avoided.

DESCRIPTION OF THE PREFERRED EMBODIMENT

Figure 1:
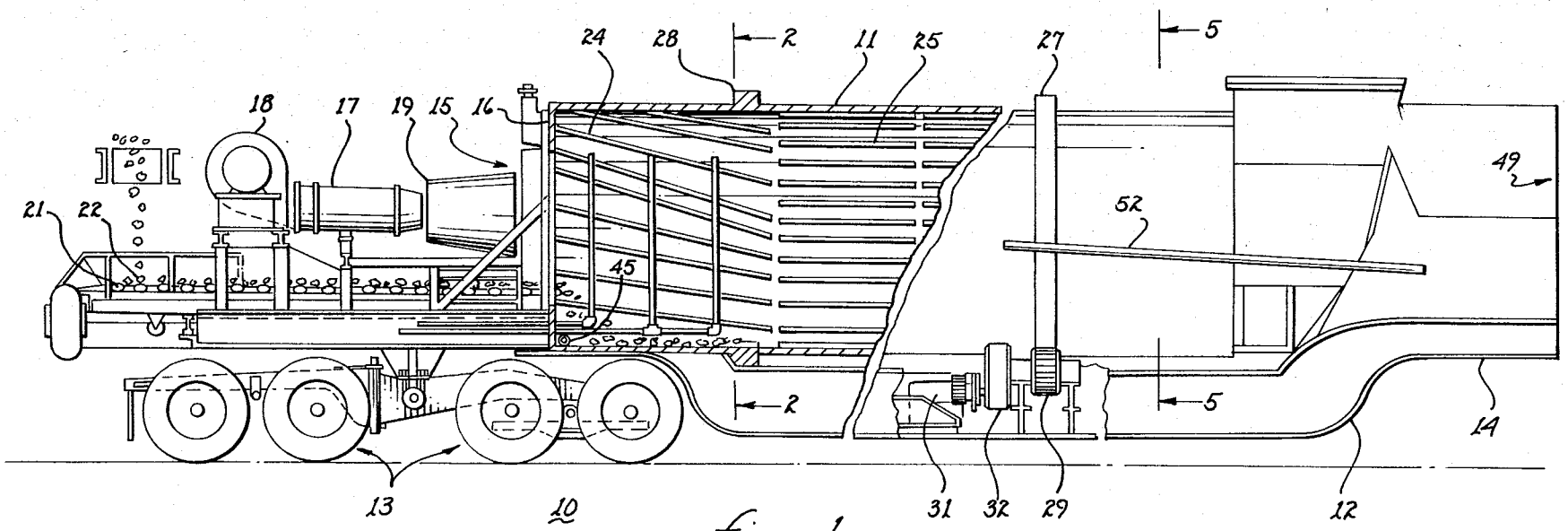
FIG. 1 is an overall pictorial diagram, partly cut away, to expose the inner design of one form of drum mixer with which this invention may be used.

Referring to the drawings, there is shown a drum mixer 10 comprising a drum 11 mounted on a frame 12 which is adapted to be supported by a series of wheels 13 at one end and may be adapted to be supported at its other end 14 by the fifth wheel of a wheeled tractor for towing the drum to any point of use.

The intake end 15 of the drum includes a fire wall 16 with an opening therethrough through which the flame and hot gases may enter the drum. The hot gases and flame are created by a burner 17 and blower 18 as is well understood in this art. The ignited fuel and air mixture from the burner 17 pass through the ignition port 19 and thus into the drum interior.

Disposed underneath the burner 17 is a conveyor belt 21 that carries the raw material such as gravel aggregate, or broken up parts of asphalt pavement which are to be re-cycled, into the intake of the drum, the aggregate or re-cycled asphalt pavement being designated by the reference character 22. The raw material 22 may be supplied to the input of the apparatus by a further supply conveyor shown by the reference character 23.

Adjacent the forward end of the drum 11 are a series of blades, or flights, 24 that are in effect spirally formed on the interior of the drum surface. This is shown by the fact that the flights 24 are disposed at an angle as may be seen in FIG. 1. Because of the angular disposition of the flights 24, the material 22 conveyed into the interior of the drum and falling on to its interior surface is picked up by the flights 24 and is moved through the interior of the drum to the point at which further mixing flights 25 are disposed.

The exterior surface of the drum includes a pair of tires 27 and 28 that surround the circumference of the drum. The tires 27 and 28 rest on rollers 29 of which only one is shown. The roller 29 may be driven by a suitable motor 31 and gear box 32 so that the drum 11 may be rotated during the mixing process.

For controlling the amount of particulate matter introduced into the heated gas current and for controlling the temperature across the interior surface of the drum to prevent combustion of the bituminous or asphaltic material, the water spray system of the invention is introduced into the input area of the drum.

Vertically extending pipes 33 and 34 are disposed at the respective sides of the drum interior and are connected together by a common pipe 35 and are supplied from a supply pipe or conduit 36. Small holes 37 are formed in each of the vertical pipes 33 and 34 and are relatively closely spaced together. The axes of the holes 37 are disposed at an angle of about thirty-five degrees to a plane perpendicular to the axis of the drum. Thus, when water squirts out of holes 37 a curtain of water in effect, is formed whose sides are at thirty-five degrees as indicated. The sides of the water curtain are shown by the dotted lines 38. The combined streams of water 38 form, in effect, a water shield protecting the environment exterior thereto from the intense heat of the flame and heated gases formed by the burner.

Figure 3:
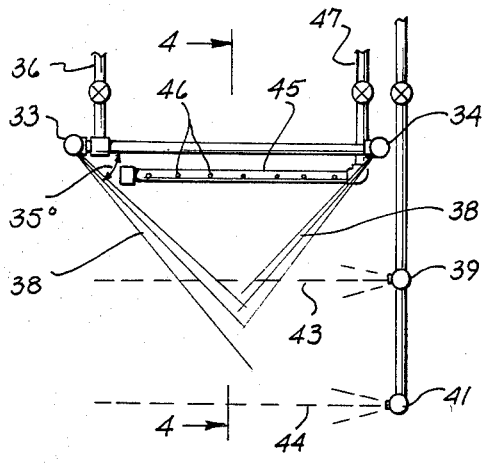
FIG. 3 is a plan view on a larger scale of the water injection system shown in FIG. 2.
Figure 4:
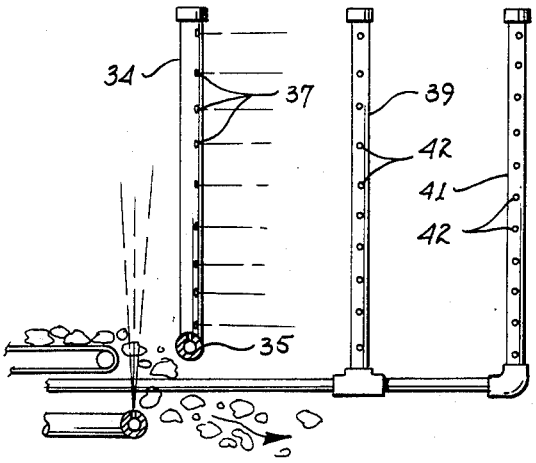
FIG. 4 is a view taken in direction of arrows 4—4 of FIG. 3.

If additional water shielding is necessary, a further pair of water pipes 39 and 41 are disposed in line with each other and further downstream with respect to the vertical pipe 34. The pipes 39 and 41 are disposed at only one side of the drum as may be seen in FIGS. 3 and 4. Each of the vertical pipes 39 and 41 include a series of small holes 42 from which water may squirt directly across the drum 11, that is to say in a direction perpendicular to the axis of the drum. The additional streams of water or water shields may be designated by the reference characters 43 and 44.

Disposed between the conduit or pipe 35 and the intake of the drum is a further pipe or conduit 45 extending transversely of the drum and underneath the area where the material being conveyed into the drum by the conveyor 21 falls into the drum. The pipe 45 has a series of small holes 46 disposed therein which holes are disposed with their axes vertically, that is to say that a stream of water coming from them will project vertically into the pathway of the falling raw material. In this manner any fine particles which may be in the form of dust, for example, come into contact with the water spray and are settled down into the interior of the drum for exposure to the temperature inside of the drum to be appropriately melted rather than to be picked up and swept along by the current of heated gases moving through the drum. Particulate contamination of the atmosphere is thus avoided. The pipe 45 is connected to a supply pipe 47 through which water is supplied. Appropriate valves, shown diagrammatically, are provided for all of the supply pipes as will be understood.

It has been found that for best results the holes 37, 42 and 46 should be about one-sixteenth of an inch in diameter and should be supplied with water at about one hundred fifty pounds per square inch. If too much water is delivered, the capacity of the unit to deliver properly mixed materials is apt to be reduced. Water supplied at a rate of about thirty to fifty gallons per minute will enable the apparatus to deliver about three hundred to three hundred fifty tons of mixed aggregate per hour.

Figure 7:
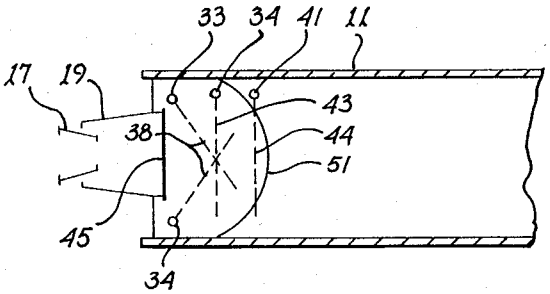
FIG. 7 is a similar diagramatic view illustrating the apparatus and the temperature distribution across the interior of the drum when the invention is functioning.
Figure 6:
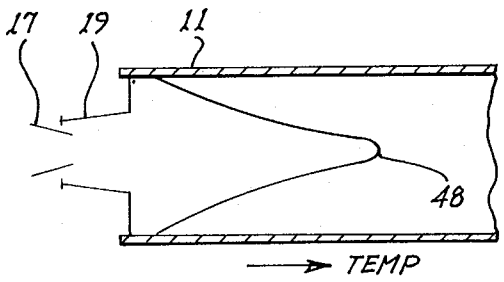
FIG. 6 is a schematic view illustrating a portion of the apparatus and the temperature distribution across the interior of a conventional heating drum.
Figure 2:
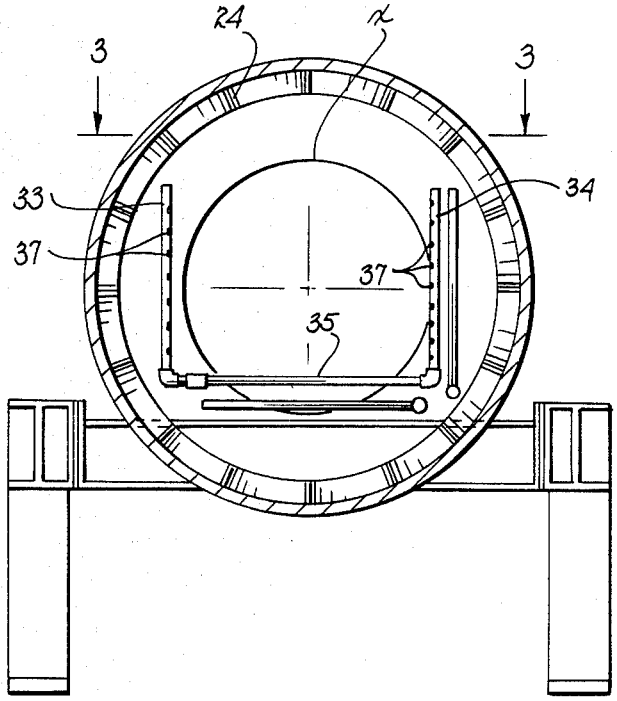
FIG. 2 is a sectional view taken substantially in the direction of the arrows 2—2 of FIG. 1 and showing the arrangement of the water injection system.
Figure 5:
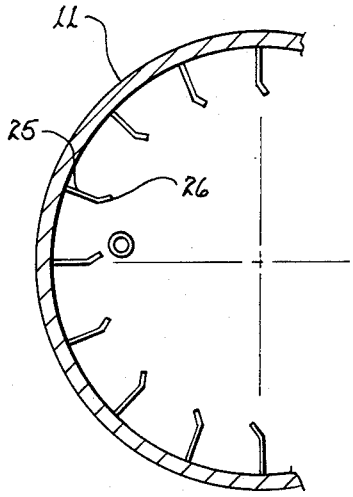
FIG. 5 is a sectional view on a larger scale taken substantially in the direction of the arrows 5—5 of FIG. 1.

Referring to FIG. 2, there is shown diagrammatically a temperature profile of the flame and heated gases in the interior of a conventional drum relative to the distance of the intake end of the drum. The temperature at the peak 48 which may exist at about the end of the flights 24, in the absence of the water curtain of the invention, can reach the vicinity of twenty-two hundred degrees Fahrenheit. Flame and gases at this temperature, of course, will burn small particles of asphalt or the like and cause heavy dense smoke to come out of the exhaust 49 of the drum. The emission of such heavy smoke is, of course, objectionable under governmental and other regulations and has to be prevented. When water is supplied under the pressure and volume as indicated above through the conduits 33, 34 and 35 and, if necessary, 39 and 41 the maximum temperature in the profile of temperature is much reduced. This is shown in FIG. 7 where the maximum temperature would be the greatest extent of the curve 51 which can be seen is of much lesser magnitude than the peak 48 shown in FIG. 6. The maximum temperature with the water curtain apparatus of the invention functioning would be about 1200° F. Under these conditions the particles of asphalt or the like would not burn and dense smoke would not emit from the exhaust 49. An experienced observer can, by observing the density of the exhaust at 49, conclude whether or not more or less water should be applied to the various pipes of the system as disclosed.

It has also been observed that supplying too much water can reduce the capacity of the unit to produce appropriately mixed aggregate and asphalt.

Having the water spray vertically through the openings 46 from pipe 45 into the pathway of the particles of asphalt or the like falling from the conveyor 21 into the interior of the drum 11, dampens these particles and causes them to collect in the interior of the drum as already described. There is no tendency for these fine particles or fines as they are known in the trade to accumulate on the conveyor belt, for example, which could necessitate frequent cleaning thereof as has been the case with some known systems.

The piping system of the present invention can be easily retrofitted into existing drum mixer units. It is likewise less expensive than other known drum mixer systems in the first instance.

The invention also enables drum mixer units to recycle one hundred percent of used material without having to add some additional new or virgin material at the very beginning. In those instances where additional asphalt or the like needs to be added, it may be added near the middle or toward the end of the drum mixer as through a conduit or pipe 51.

Along with these advantages the production rate of units is dramatically increased from known capacities of about one hundred seventy-five tons per hour to three hundred to three hundred fifty tons per hour.

While one form of the invention has been disclosed it will be understood that other modifications may be made that come within the spirit and scope of the disclosure.

We claim:

1. In a bituminous paving composition mixer that includes a rotatable drum having a discharge end and a receiving end, means for the introduction of raw materials into the intake end, gaseous heating apparatus disposed adjacent the intake end including means for blowing heated gases and flame into the intake end of the drum for melting the bituminous material, and means for controlling the temperature distribution of the flame and gases across the interior of the entrance of the drum during operation, said last named means comprising first apparatus for generating a series of water sprays at the entrance of said drum directed into the path of said flame and heated gases, said first water spray generating apparatus including means for directing the spray at an angle of about thirty-five degrees to a plane at right angles to the drum axis, and wherein the first water spray generating apparatus further includes additional means for directing closely spaced water sprays into the path of said flame and heated gases, said additional means being spaced downstream from said first water spray generating means.

2. In a bituminous paving composition mixer that includes a rotatable drum having a discharge end and a receiving end, means for the introduction of raw materials into the intake end, gaseous heating apparatus disposed adjacent the intake end including means for blowing heated gases and flame into the intake end of the drum for melting the bituminous material, and means for controlling the temperature distribution of the flame and gases across the interior of the entrance of the drum during operation, said last named means comprising first apparatus for generating a series of water sprays at the entrance of said drum directed into the path of said flame and heated gases, said first water spray generating apparatus including means for directing the spray at an angle of about thirty-five degrees to a plane at right angles to the drum axis, said first water spray generating apparatus further including additional means for directing closely spaced water sprays into the path of said flame and heated gases, said additional means being spaced downstream from said first water spray generating means, and said additional means comprising a pair of water spray conduits vertically disposed downstream of each other and each including a series of closely spaced holes for directing streams of water horizontally into the path of said flame and heated gases.

3. In a bituminous paving composition mixer that includes a rotatable drum having a discharge end and a receiving end, means for the introduction of raw materials into the intake end, gaseous heating apparatus disposed adjacent the intake end including means for blowing heated gases and flame into the intake end of the drum for melting the bituminous material, and means for controlling the temperature distribution of the flame and gases across the interior of the entrance of the drum during operation, said last named means comprising first apparatus for generating a series of water sprays at the entrance of said drum directed into the path of said flame and heated gases, and still further apparatus disposed upstream from said first apparatus for generating a series of sprays directed vertically into the path of said raw material prior to any substantial contact thereof with said flame and hot gases.

4. In a bituminous paving composition mixer that includes a rotatable drum having a discharge end and a receiving end, means for the introduction of bituminous raw material into the receiving end, gaseous heating apparatus disposed adjacent the receiving end including means for blowing heated gases and flame into the receiving end of the drum for melting the bituminous raw material, first means for controlling the temperature distribution of the flame and gases across the interior of the entrance of the drum during operation and second means for avoiding the introduction of fine materials from said raw bituminous materials into the stream of heated gases and flame, said first means comprising first apparatus for generating a series of water sprays at the entrance to said drum directed into the path of said flame and heated gases, and said second means comprising second apparatus for generating a series of water sprays ahead of the water sprays of said first apparatus and directed into the path of said bituminous raw material prior to exposure thereof to said flame and heated gases.

5. The mixer according to claim 4 wherein the first water spray generating means comprises a pair of water conduits, one each at each side of said drum entrance, and each conduit includes a series of closely spaced holes whose axes are at about thirty-five degrees to a plane perpendicular to the axis of said drum, and said second water spray generating apparatus comprises a water conduit transversely of the path of said bituminous raw material and having a series of closely spaced holes whose axes are perpendicular to said path.

6. The mixer according to claim 5 including additional water spray means comprising a pair of water spray conduits vertically disposed downstream of each other and each including a series of closely spaced holes for directing streams of water horizontally into the path of said flame and heated gases.

7. The method of processing re-cycled bituminous road surfacing materials comprising the steps of generating a current of high temperature gases at the receiving end of a rotatable mixing drum, conveying raw bituminous material into the receiving end of said drum, spraying a curtain of water into the path of said raw material prior to exposure thereof to the high temperature gases, spraying a curtain of water into the current of high temperature gases, exposing said raw bituminous material to the current of high temperature gases after subjection thereof to said water curtain, and conveying the heated and mixed raw material to the discharge of said drum.

* * * * *